US010462855B2

(12) United States Patent
Dughiero et al.

(10) Patent No.: US 10,462,855 B2
(45) Date of Patent: Oct. 29, 2019

(54) DEVICE FOR INDUCTION HEATING OF A BILLET

(75) Inventors: Fabrizio Dughiero, Piove di Sacco (IT); Michele Forzan, Padua (IT); Marcello Zerbetto, Padua (IT)

(73) Assignee: INOVA LAB S.R.L., Padua (IT)

( * ) Notice: Subject to any disclaimer, the term of this patent is extended or adjusted under 35 U.S.C. 154(b) by 927 days.

(21) Appl. No.: 14/381,936

(22) PCT Filed: Mar. 1, 2012

(86) PCT No.: PCT/IB2012/050979
§ 371 (c)(1),
(2), (4) Date: Dec. 5, 2014

(87) PCT Pub. No.: WO2013/128241
PCT Pub. Date: Sep. 6, 2013

(65) Prior Publication Data
US 2015/0083713 A1 Mar. 26, 2015

(51) Int. Cl.
*H05B 6/42* (2006.01)
*H05B 6/10* (2006.01)
*H05B 6/14* (2006.01)

(52) U.S. Cl.
CPC ..... *H05B 6/42* (2013.01); *H05B 6/102* (2013.01); *H05B 6/145* (2013.01)

(58) Field of Classification Search
CPC ..... H05B 6/102; H05B 6/42; H05B 6/145; H05B 6/105; H05B 6/362; H05B 6/36;
(Continued)

(56) References Cited

U.S. PATENT DOCUMENTS 3,716,750 A * 2/1973 Nakada ..... F28F 1/105 313/157
3,781,592 A * 12/1973 Harrold ..... H01F 7/0278 315/39.71

(Continued)

FOREIGN PATENT DOCUMENTS

CN 101965073 2/2011
WO 2001035702 5/2001

(Continued)

OTHER PUBLICATIONS

International Search Report dated Nov. 26, 2012 corresponding to PCT/IB2012/050979; 5 pages.

(Continued)

*Primary Examiner* — Ibrahime A Abraham
*Assistant Examiner* — Gyounghyun Bae
(74) *Attorney, Agent, or Firm* — Pearne & Gordon LLP

(57) ABSTRACT

A device for the induction heating of a billet of metal of high electrical conductivity has: a tubular body supporting a plurality of permanent magnets arranged inside the tubular body, angularly spaced apart from each other and arranged so as to be alternated with opposite polarities. The device also has a support for the billet that is arranged inside the tubular body and faces the magnets. The device also has a motor adapted to rotate the tubular body with respect to the billet in order to induce currents in the billet that circulate within the metal material, obtaining the heating of the billet by the Joule effect. An integral cooling system for the permanent magnets is provided, this being carried by the tubular body and suitable for feeding cooling air flows between adjacent permanent magnets.

16 Claims, 5 Drawing Sheets

(58) Field of Classification Search

CPC ..... H05B 3/0095; G03G 15/2053; G03G 15/2064; F28D 7/10; F28D 7/106; F28D 2021/0077; F28D 2021/0078; F27D 3/026; D21G 1/0266; F28F 1/42; F28F 1/20; C21D 9/00; C21D 9/62; C21D 9/46; B21J 5/08; B21J 1/06; B21D 37/16; B21D 1/06; B21K 29/00; F26B 13/18; F26B 13/183; F26B 13/186

USPC ..... 219/632, 635, 677, 672; 432/60, 228, 432/246; 492/46; 165/154, 179, 183; 266/249, 104; 72/342.1–342.96

See application file for complete search history.

(56) References Cited

U.S. PATENT DOCUMENTS 3,994,678 A * 11/1976 Nelson ..... F27B 9/36 432/128
4,350,861 A 9/1982 Pouillange et al.
4,412,146 A * 10/1983 Futterer ..... H02K 1/17 310/154.04
4,639,084 A * 1/1987 Kugioka ..... G02B 7/08 310/112
4,761,527 A * 8/1988 Mohr ..... H05B 6/102 219/635
4,874,916 A * 10/1989 Burke ..... H05B 6/02 219/671
5,141,158 A * 8/1992 Allen ..... B05B 3/006 239/252
5,306,365 A * 4/1994 Reighard ..... C22F 1/04 148/511
5,448,039 A * 9/1995 Okayama ..... C21D 9/0081 219/632
5,448,040 A * 9/1995 Deplano ..... F27D 3/026 219/647
5,554,836 A * 9/1996 Stanescu ..... F27B 9/047 219/651
5,678,237 A * 10/1997 Powell ..... C03B 5/005 219/660
6,163,562 A * 12/2000 Franci ..... H05B 6/24 219/653
6,177,660 B1 * 1/2001 Usui ..... H05B 6/108 219/618
6,730,893 B1 * 5/2004 Runde ..... H05B 6/365 219/635
2005/0006380 A1 * 1/2005 Kagan ..... H05B 6/04 219/661
2006/0000826 A1 * 1/2006 Cordier ..... B21B 45/004 219/646
2006/0157476 A1 * 7/2006 Magnusson ..... H05B 6/102 219/622
2009/0255923 A1 * 10/2009 Buehrer ..... H05B 6/145 219/635
2010/0089312 A1 * 4/2010 Wiseman ..... C30B 11/003 117/206
2010/0147833 A1 * 6/2010 Buehrer ..... H02K 55/04 219/647
2011/0272399 A1 * 11/2011 Berdut-Teruel ..... H05B 6/108 219/672
2011/0315677 A1 * 12/2011 Suominen ..... H05B 6/102 219/660
2012/0080424 A1 * 4/2012 Wiezoreck ..... H05B 6/06 219/652

FOREIGN PATENT DOCUMENTS

WO 2004066681 5/2004
WO 2010100082 9/2010
WO WO 2010100082 A2 * 9/2010 ..... H05B 6/102

OTHER PUBLICATIONS

Written Opinion dated Nov. 26, 2012 corresponding to PCT/IB2012/050979; 6 pages.

Chinese Office Action (with machine translation) dated Jun. 16, 2015 corresponding Chinese Patent Application No. 201280069693.9; 5 pages.

* cited by examiner

DEVICE FOR INDUCTION HEATING OF A BILLET

BACKGROUND OF THE DISCLOSURE

Field of the Disclosure

The present invention relates to a device for the induction heating of a billet.

Description of Related Art

The induction heating of a billet of non-ferromagnetic material can be carried out by using an inductor powered at an appropriate frequency (traditional technique), but this system does not permit reaching efficiency levels of more than 50%. Patent application PCT WO04066681 describes a device for the induction heating of a billet of a non-magnetic, conductive metal material (for example, copper or aluminium) in which a magnetic field produced by permanent magnets moves with respect to the metal billet, creating induced currents that circulate within the metal conductor material, in this way heating it by the Joule effect. However, this system is not completely satisfactory for series production.

BREIF SUMMARY OF THE DISCLOSURE

The object of the present invention is that of providing a device able to overcome the drawbacks of known devices, in particular one having small size, high reliability, relatively low installation and running costs and extreme simplicity and versatility.

The invention therefore relates to a device for the induction heating of a billet of a non-ferromagnetic metal material having relatively high electrical conductivity, comprising: at least one tubular body, in turn comprising a plurality of permanent magnets arranged in a ring parallel to respective generatrices of the tubular body, angularly spaced apart from each other and arranged so as to be alternated with opposite polarities; at least one support of said billet adapted to support, in use, the billet arranged within said tubular body and facing said magnets; and driving means to obtain, in use, a relative rotation between the tubular body and said billet in order to produce, due to the relative motion of said magnets with respect to the metal material of the billet, induced currents in said billet that circulate within the billet itself, thereby obtaining the heating of the metal material by the Joule effect; characterized in that it further comprises a cooling system for said permanent magnets integrally carried by said tubular body and suitable for feeding cooling air flows between adjacent permanent magnets.

The invention is also related to a method for obtaining the induction heating of a billet of metal material of relatively high electrical conductivity comprising the step of: carrying out a relative rotation between said billet and a plurality of permanent magnets arranged in a ring facing the billet and angularly spaced apart from each other, arranged so as to be alternated with opposite polarities in order to produce, owing to the relative motion of said magnets with respect to the metal material, induced currents in said billet that circulate within the billet itself, thereby obtaining the heating of the metal material by the Joule effect; characterized in that it further comprises the step of cooling said permanent magnets by means of an air flow that circulates between adjacent magnets.

Furthermore, the support for the billet comprises a casing made of refractory material suitable to house said billet and able to obstruct the flow of heat from said billet heated by the Joule effect towards said permanent magnets. In particular, this casing comprises two half-shells coupled together to contain the billet.

Alternatively, the billet can be supported at its ends by a suitable mechanism. By using this solution, the layer of insulating material, suitable for protecting the magnets from the heat transmitted by the billet being heated, is arranged directly around the magnets and suitably constrained to integrally rotate with the same magnets.

According to one aspect of the invention, the cooling system comprises a plurality of tubes forming part of said tubular body, having open end portions and able to convey said cooling air, each tube being interposed between two adjacent permanent magnets and having its sidewalls placed in contact with said permanent magnets.

In this way, the drawbacks of the known art are completely overcome. In fact, the heat irradiated from the billet to the permanent magnets is limited. Furthermore, whatever the case, most of the heat is carried away by the flow of cooling air that circulates in the tubes, which are preferably made of copper that, as well as being an non-magnetic material, is also an excellent heat conductor. This air flow is produced by the rotation of the tubular body, by means of a series of blades anchored to it.

BRIEF DESCRIPTION OF THE DRAWINGS

The invention will now be described with reference to non-limitative embodiments thereof, provided purely by way of example and with reference to the figures of the attached drawings, which represent preferred embodiments, where.

DETAILED DESCRIPTION OF THE DISCLOSURE

Figure 2:
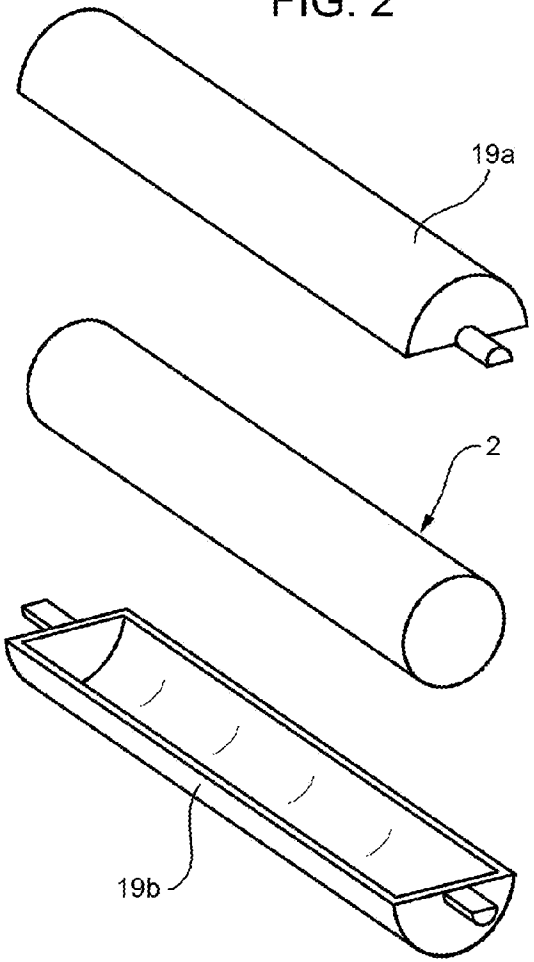
FIG. 2 shows, in an exploded perspective, a second element constituting the device according to the present invention.
Figure 1:
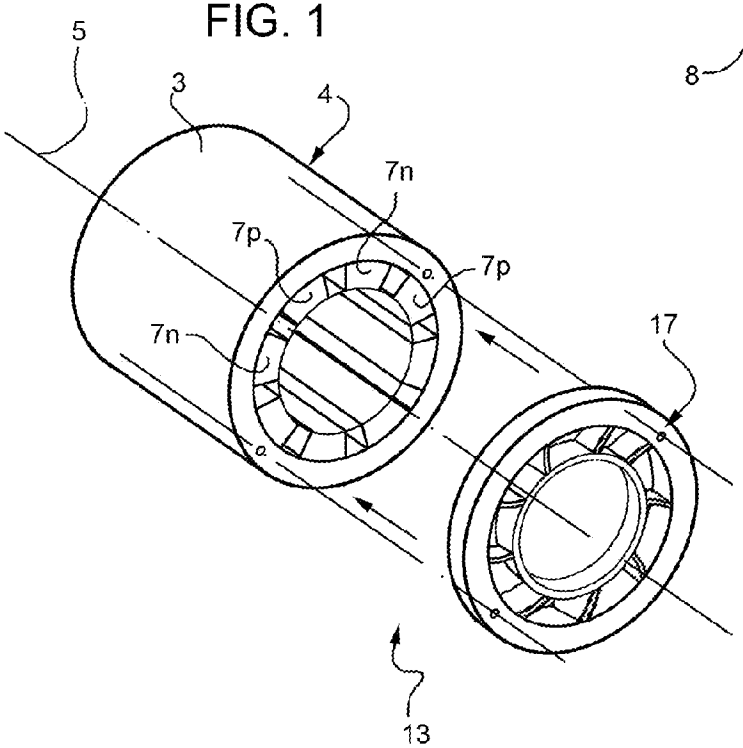
FIG. 1 shows, in perspective, a first element constituting the device according to the present invention.
Figure 3:
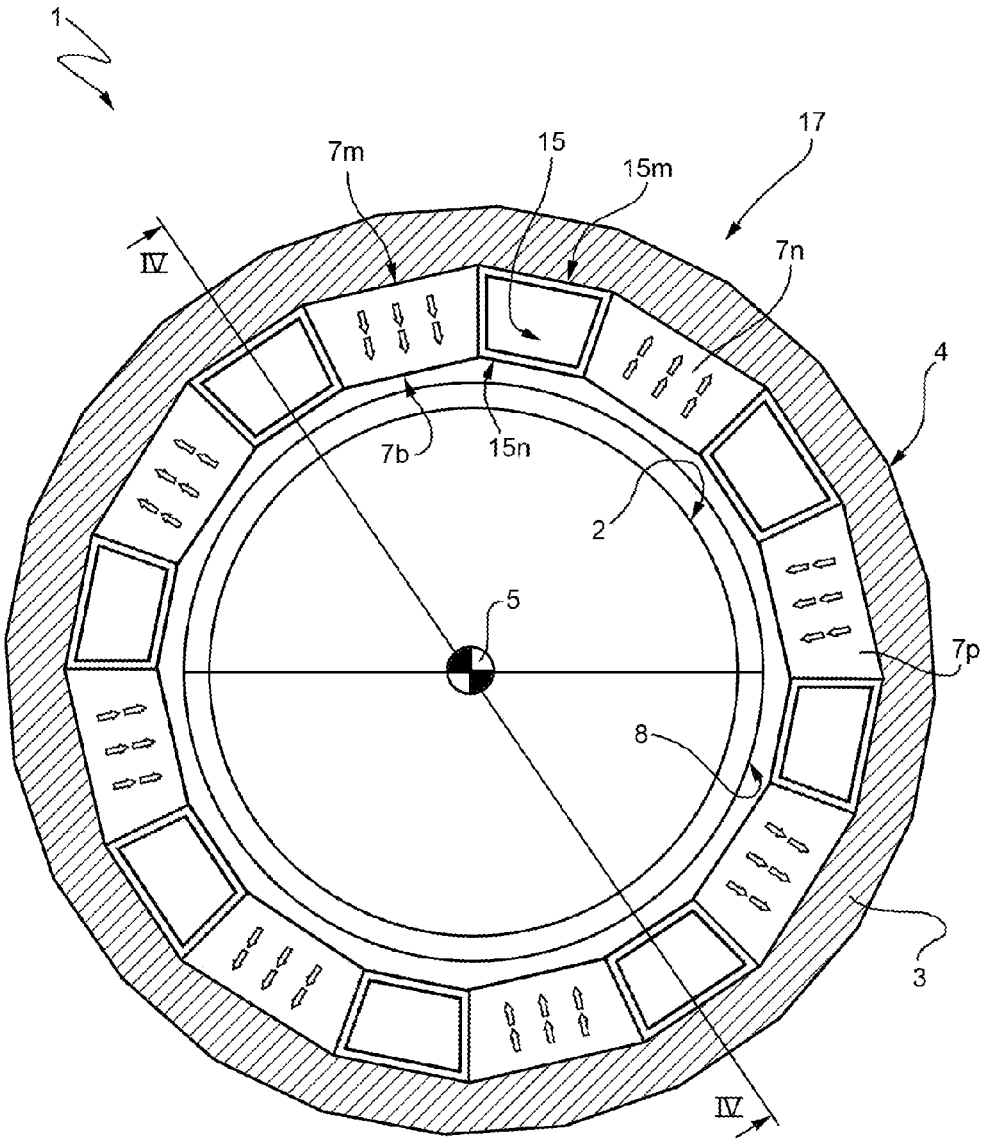
FIG. 3 shows, in cross section, the first and second elements coupled together.

In FIG. 3, reference numeral 1 indicates a device for the induction heating of a billet 2 (see FIG. 2 as well) made of a metal material of relatively high electrical conductivity (such as copper or aluminium, for example), which must be heated to a high temperature (for example, 500-600° C.) for undergoing subsequent machining processes, for example, extrusion or pressing. In the example shown, the billet 2 has a cylindrical shape with a constant circular section. Nevertheless, it is obvious that the billet 2 could have a different shape from that shown, for example, a square or polygonal section.

The device 1 comprises a tubular body 4, not limitative in the case in point shown with a substantially circular section (see FIG. 3 as well), having an axis of symmetry 5 with respect to which, in use, it is arranged substantially coaxial to the billet 2; the tubular body 4 comprises a plurality of elongated permanent magnets 7*p* and 7*n* arranged in a ring parallel to respective generatrices of the tubular body, i.e. extending parallel to the axis 5, angularly spaced apart from each other and arranged so as to be alternated with opposite polarities along the cylindrical inner surface of the tubular body 4, which they partially define.

The device 1 further comprises a support 8 for the billet 2 able to support it, in use, such that the billet 2 is arranged inside the tubular body 4 (FIG. 3) so that it faces the magnets 7*p* and 7*n* that surround the billet 2. In particular, in the example shown in FIG. 2, the support 8 is able to at least partially house the billet 2 within itself, at least in front of the permanent magnets 7*n* and 7*p* and is made of a refractory material.

A drive device 10 (schematically shown in FIG. 4) is also provided that is suitable to provide rotation between the tubular body 4 and the billet 2 in order to produce, owing to the relative motion of the magnets 7*p* and 7*n* with respect to the metal material of high electrical conductivity, induced currents in billet 2 that circulate within the billet itself, thereby obtaining the heating of the metal material by the Joule effect.

Typically, the tubular body 4 rotates with respect to the billet 2 (held still by the support 8), behaving like a rotor. As is known, the same effect can be obtained by making the billet rotate with respect to the magnets, which can be kept stationary.

According to the present invention, a cooling system 13 for permanent magnets 7*p* and 7*n* is provided, integrally carried by the tubular body 4 and able to feed cooling air flows between adjacent permanent magnets 7*p* and 7*n*.

This system 13 contributes to the continuous cooling of the magnets, preventing them from losing efficiency due to being heated by any heat radiation from the billet 2.

In greater detail (FIG. 3), in addition to the alternately arranged magnets 7*p* and 7*n*, the tubular body 4 also comprises a tubular outer casing 3, made of a magnetic material (steel for example), which internally has a polygonal section (a 16-sided polygon in the example) and internally houses elongated permanent magnets having an isosceles trapezoidal section, with the larger face 7*m* arranged firmly in contact with the casing 3 and the smaller face 7*b* facing towards the inside of the tubular body 4 and therefore, in use, towards the billet 2.

The permanent magnets 7*n* and 7*p* have radial polarizations and are preferably made of metal alloys comprising rare earths such as neodymium or samarium. As is known, the chemical elements called rare earths (or lanthanides) have electron level f (which can accommodate up to 14 electrons) only partially filled. The spin of the electrons in this level can be easily aligned in the presence of strong magnetic fields and it is therefore in these situations that magnets constituted by rare earths are used. The more common varieties of these magnets are samarium-cobalt magnets and neodymium-iron-boron magnets.

The cooling system 13 comprises a plurality of tubes 15 that also form part of the tubular body 4, in this case, carried inside the casing 3, inserted axially within it and alternating with the permanent magnets 7*n* and 7*p*, and therefore arranged parallel to the axis 5, i.e. parallel to the longitudinal development of the magnets 7*n* and 7*p*, so as to define with them (in the case in point, with the faces 7*b*) the inner surface of the tubular body 4. The tubes 15 have opposite end portions 151 (FIG. 4) open to the outside of the tubular body 4, able to establish a flow of cooling air; as can be clearly seen in FIG. 3, each tube 15 is inserted between two permanent adjacent magnets 7*p* and 7*n* and has its sidewalls arranged in contact with the permanent magnets 7*p* and 7*n* adjacent to it. In particular, the tubes 15 also have a trapezoidal cross-section, complementary to that of the magnets 7*n* and 7*p*, so as to define with them an uninterrupted closed ring around the axis 5. In this way, the air that flows in a tube 15 helps to cool two magnets 7*n* and 7*p* with opposite polarities.

The tubes 15 conveniently have an isosceles trapezoidal section with the larger face 15*m* arranged firmly in contact with the inside of the casing 3*e* and the smaller face 15*n* facing towards the inside of the tubular body 4 and then, in use, towards the billet 2, and are arranged flush with the faces 7*b* of the permanent magnets 7*n* and 7*p*.

The cooling system 13 can be assisted by a fan 17 carried angularly integral with the tubular body 4 and provided with blades 18 arranged along a circular path having a shape and arrangement such that the blades 18 face first ends of the tubes 15 and convey an air flow inside the tubes 15 as a result of the rotation of the tubular body 4 around the axis 5. In this way, upon the rotation of the tubular body 4, the blades 18 of the fan 17 ensure the continuous circulation of air inside the tubes 15.

The support 8 shown in FIG. 2 comprises a casing made of refractory material (a ceramic material for example) suitable to house the billet 2 and able to obstruct the flow of heat from the billet heated by the Joule effect towards the permanent magnets 7*p* and 7*n*.

This stratagem further contributes to prevent heating of the magnets.

In particular, the casing defining the support 8 has a tubular shape and comprises a first half-shell 19*a* and a second half-shell 19*b* that couple together in the longitudinal direction and are able, when coupled together, to house the billet 2.

Figure 4:
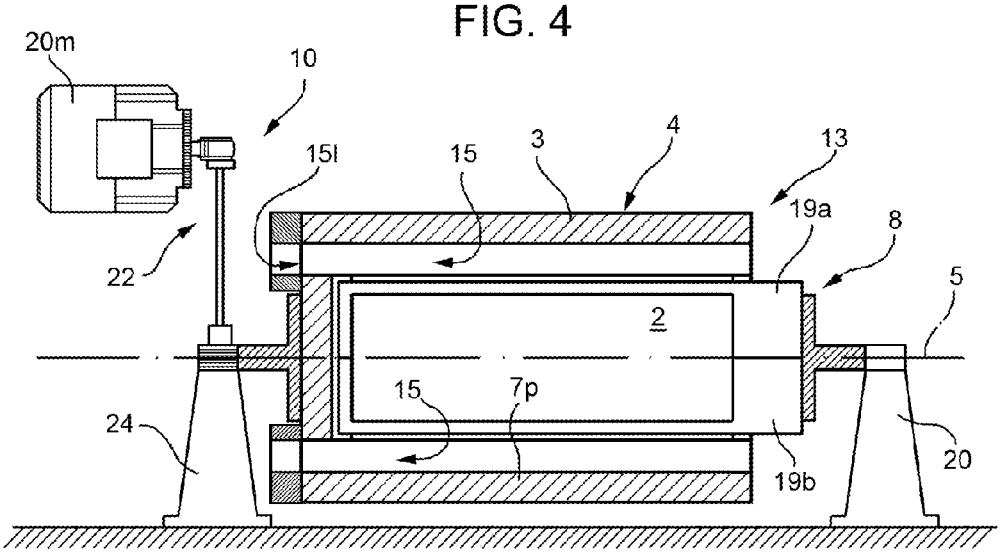
FIG. 4 shows, in longitudinal section, the device in FIG. 3.

In the embodiment schematically shown in FIG. 4, the support is connected by a projection at one end to a vertical support 20. The drive device 10 comprises an electric motor 20*m*, which sets the tubular body 4 in rotation through a transmission 22 (shown schematically). In turn, the tubular body 4 is supported by a vertical support 24 and is angularly moveable with respect to the latter under the thrust of the motor 20*m*.

Figure 5:
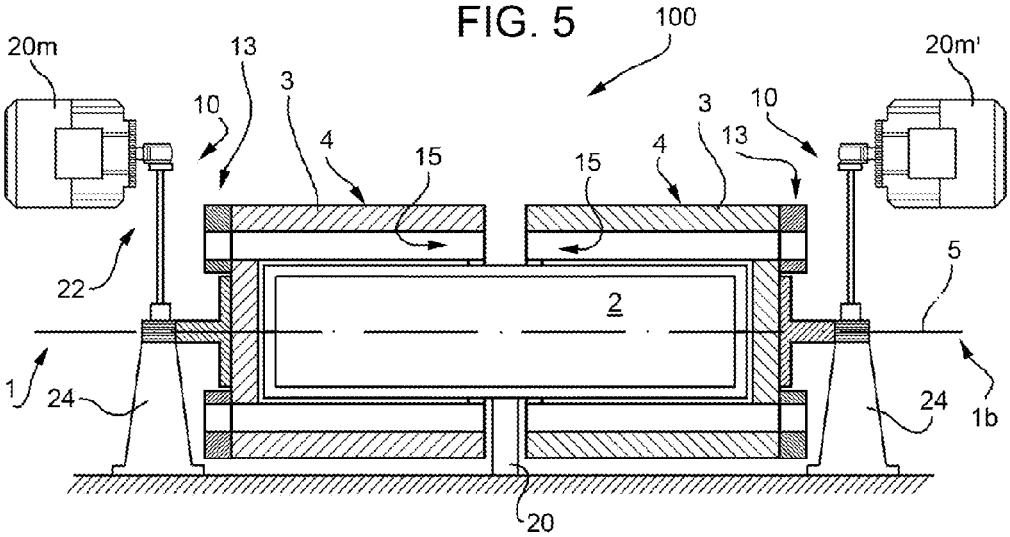
FIG. 5 shows the same longitudinal section view of FIG. 4 for a first variant of the device in FIG. 4.

In the embodiment in FIG. 5, a first portion of a billet 2 is housed inside the cavity of a first tubular body 4 of a first heating device 1 equipped with a first plurality of magnets 7*n* and 7*p* arranged in a ring in the manner already described, while a second portion of the same billet is housed inside the cavity of a second tubular body 4 of a second heating device lb having the same structure as device 1 and equipped with a second plurality of magnets 7*n* and 7*p* arranged in a ring in the manner already described, while the billet 2 is supported in a manner obvious to an expert in the field, for example along the centre line, by a support 20. The variant in FIG. 5 therefore implements a complex heating system 100 that enables temperature gradients to be created in the billet 2; this system 100 can thus be used to heat billets 2 in a differentiated manner, by making the tubular body 4 of the devices 1 and lb (which have mutually independent and individually controlled motors 20*m* and 20*m*') rotate at different speeds for this purpose. Obviously, by multiplying the number of tubular bodies driven in rotation independently of each other, it is possible to implement a heating system having any number "n" of different zones of differentiated heating.

It is also possible to produce different differentiated heating profiles by making a handling system that implements an alternating movement of the billet 2 and the tubular body 4 along the axis 5.

Figure 6:
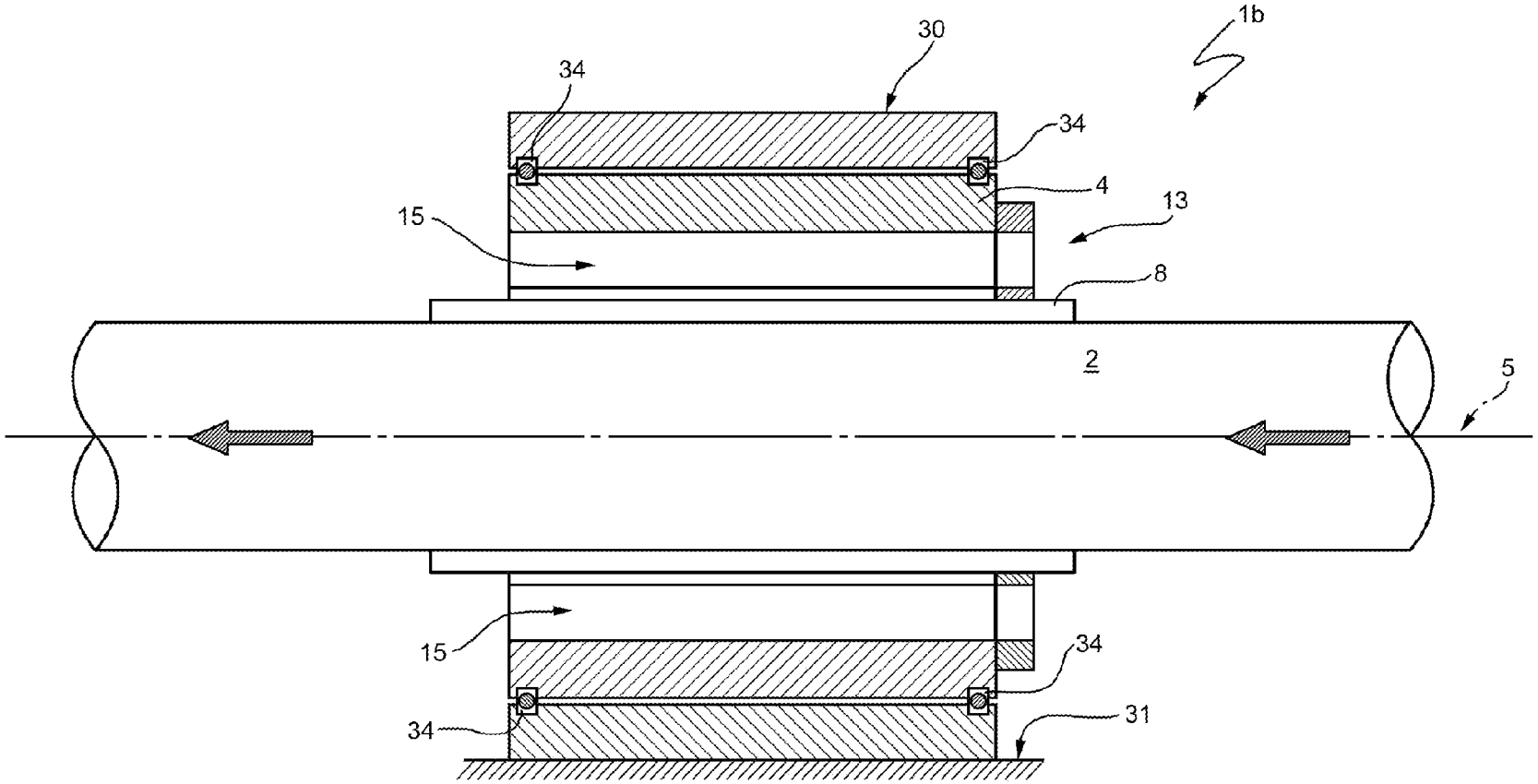
FIG. 6 shows a second variant of the device in FIG. 4.

In the embodiment shown in FIG. 6, a device 1*b* that in all other respects is identical to the already described device 1, has the tubular body 4 mounted coaxially inside another tubular body 30, which is supported by a supporting wall 31 lateral to the axis 5. The rotation of the tubular body 4 with respect to the tubular body 30 is provided by a plurality of bearings 34 inserted between the two tubular bodies by means of known techniques. In this way, the process of heating the billet 2 can be carried out continuously, using a support 8 in a refractory material, this also being tubular, and feeding a "continuous" (or rather, very long) billet 2 along the axis 5 and then, as its contiguous portions are heated to the desired temperature, gradually feeding it in a known manner to an extrusion machine, known and not shown for simplicity.

Figure 7:
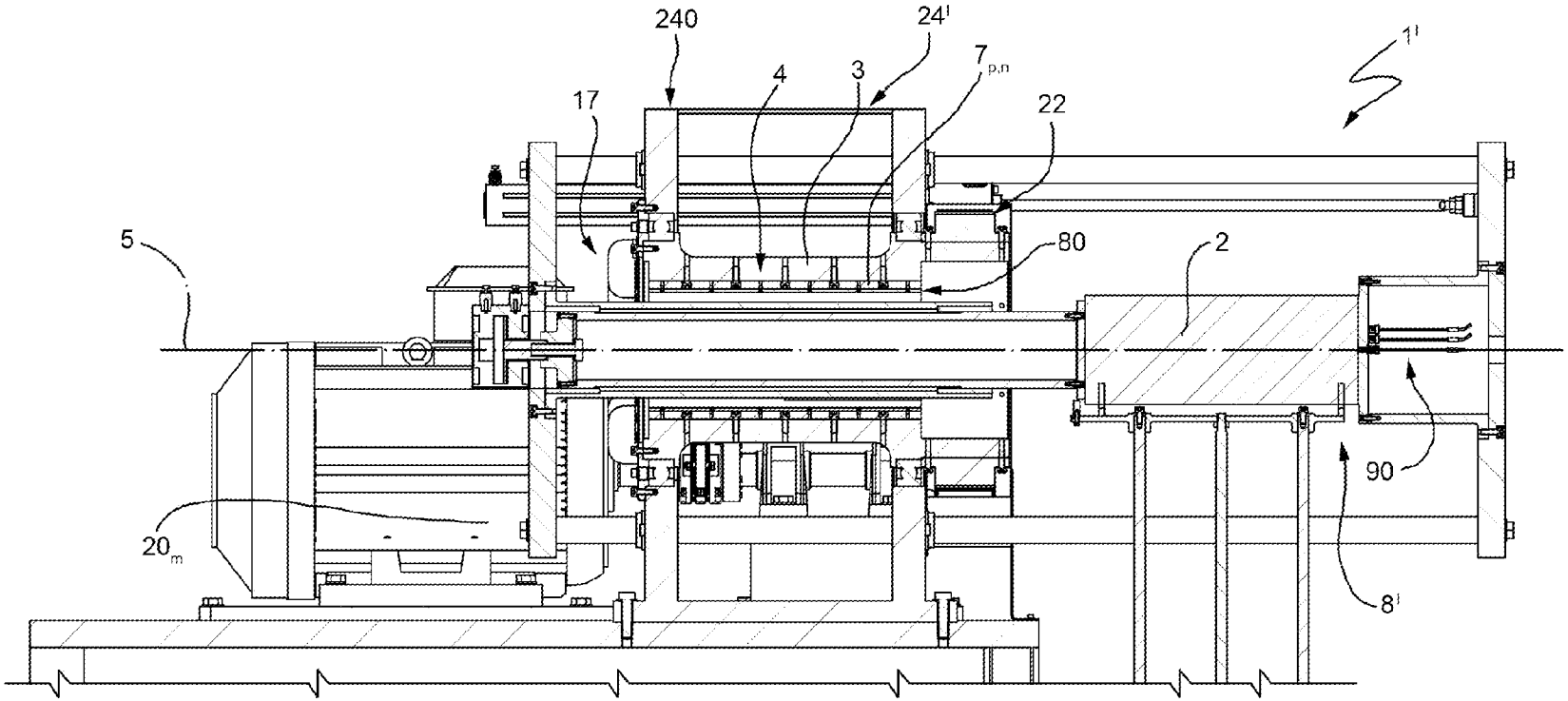
FIG. 7 schematically shows a longitudinal view in elevation of a further possible constructional variant of the invention.

With reference to FIG. 7, where a constructively improved variant 1' of device 1 is schematically shown, the billet 2 is supported at its ends by a support 8'; a support 24' is associated with support 8'; support 24' carries a slide 240, which can slide parallel to the axis 5 and is driven by opportune pistons (not shown), which freely supports the tubular body 4 by opportune bearings and is associated with the motor 20*m* that is connected to the tubular body 4 through the transmission 22; the tubular body 4 is fitted with a fan 17 carried integrally on the casing 3 and, by making the slide 240 slide, it can be translated parallel to its axis 5 so as to fit it, in use, around the billet 2 mounted coaxially to the axis 5 on support 8', or move it, laterally to support 8' to enable the billet 2 to be positioned on it and removed from it.

In using this solution, to shield the magnets 7*n* and 7*p* forming part of the tubular body 4, the remainder of which is made in the already described manner, the tubular body 4 comprises an extra element, defined by a tubular sheath 80 made of a refractory material, mica for example, interposed between the magnets 7*n* and 7*p* and the axis 5. This sheath or layer 80 of insulating material is able to protect the magnets 7*n* and 7*p* from the heat transmitted by the billet 2 being heated and is placed directly around the magnets 7*n* and 7*p* and opportunely anchored to them so as to integrally rotate with them.

Through this variant, it is also possible to equip the support 8' with appropriate instrumentation 90, composed of thermocouples and/or optical pyrometers for example.

Based on what has been described, it is evident that by means of devices 1, 1*b*, 1' or 100, it is possible to implement a method to obtain the induction heating of a billet 2 of metal material of relatively high electrical conductivity and of any length, comprising the steps of:

carrying out a relative rotation between the billet 2 and at least a first plurality of permanent magnets 7*p* and 7*n* arranged in a ring facing the billet and angularly spaced apart from each other, arranged so as to be alternated with opposite polarities in order to produce, owing to the relative motion of the magnets with respect to the metal material of the billet, induced currents in the billet that circulate within the billet itself, thus obtaining the heating of the metal material by the Joule effect; and cooling the permanent magnets 7*n* and 7*p* by means of an air flow that circulates between adjacent magnets.

Furthermore, it is also possible to easily implement a method such as the previous one, but suited to obtaining the differentiated heating of the billet 2 along its longitudinal axis 5, coincident with that of the devices 1 and 1*b* forming the system 100, comprising the steps of:

setting up at least a first and a second plurality of permanent magnets arranged in a ring and facing different axial portions of the billet; and making the aforementioned at least first and second plurality of permanent magnets arranged in a ring rotate at different speeds with respect to the billet.

The invention claimed is:

1. A device for induction heating of a billet of metal material having high electrical conductivity comprising:

a tubular body comprising permanent magnets wherein each of the permanent magnets is arranged parallel to an axis of the tubular body, wherein the permanent magnets are arranged on a circumference of the tubular body centered on the axis of the tubular body and are angularly spaced apart from each other and arranged by alternating opposite polarities;

a billet support adapted to support the billet so that the billet is arranged in the tubular body and the billet faces the permanent magnets; and a drive device with a motor that produces a relative rotation between the tubular body and the billet, wherein the relative rotation of the permanent magnets with respect to the metal material of the billet induces current in the billet that circulates within the billet itself, thereby obtaining a heating of the metal material; and a cooling system integrally carried by the tubular body that provides a flow of cooling air on the circumference between two adjacent permanent magnets, wherein the cooling air flows in a channel located between said two adjacent permanent magnets.

2. The device according to claim 1, wherein the channel is a tube and wherein the cooling system comprises a plurality of tubes forming a part of the tubular body, the tubes having open end portions and adapted to convey the flow of cooling air, each tube being interposed between two adjacent permanent magnets with sidewalls of said each tube being placed in contact with its said two adjacent permanent magnets.

3. The device according to claim 2, wherein the cooling system further comprises at least one fan integrally carried by the tubular body and provided with blades arranged in a ring along a circular path and facing first ends of the tubes, the blades of the fan ensuring a circulation of air inside the tubes upon the relative rotation of the tubular body.

4. The device according to claim 2, wherein the tubes are made of a non-magnetic material.

5. The device according to claim 2, wherein the tubes and the permanent magnets have complementary, trapezoidal cross-sections.

6. The device according to claim 5, wherein the tubes extend in an axial direction that is parallel to the permanent magnets, and blades of a fan are arranged in a ring along a circular path defined by the alternation of the permanent magnets and the tubes.

7. The device according to claim 1, wherein the permanent magnets are radially magnetized and are made of metal compounds including rare earth elements.

8. The device according to claim 1, wherein the billet support comprises a casing made of refractory material adapted to at least partially house the billet, at least in front of the permanent magnets, so as to obstruct a heat flow from the billet towards the permanent magnets.

9. The device according to claim 8, wherein the casing comprises two half-shells, which may be coupled to each other to contain the billet.

10. The device according to claim 1, wherein the billet support supports the billet at opposite ends of the billet, coaxially to the tubular body, and wherein the tubular body comprises a protective layer made of refractory material arranged to protect the permanent magnets, the protective layer being fixed so as to integrally rotate with the permanent magnets.

11. The device according to claim 1, wherein the billet has a first portion that is housed inside a cavity of a first tubular body provided with a first plurality of permanent magnets arranged in a ring, while at least a second portion of the same billet is housed inside a cavity of at least a second tubular body provided with a second plurality of permanent magnets arranged in a ring, and wherein an individually controllable and mutually independent drive device is provided to rotate at least the first and second tubular bodies at different speeds.

12. A method for obtaining induction heating of a billet of metal material of high electrical conductivity comprising:

carrying out a relative rotation between the billet and permanent magnets: the permanent magnets being included as part of a tubular body wherein each of the permanent magnets is arranged parallel to an axis of the tubular body, wherein the permanent magnets are arranged in a ring on a circumference of the tubular body centered on the axis of the tubular body, the permanent magnets facing the billet and being angularly spaced apart from each other and being arranged so as to be alternated with opposite polarities in order to produce, due to a relative motion of the permanent magnets with respect to the metal material of the billet, induced currents in the billet that circulate within the billet itself, thus obtaining a heating of the metal material; the billet being supported by a billet support which is adapted to support the billet so that the billet is arranged in the tubular body; and cooling the permanent magnets by a cooling system integrally carried by the tubular body that provides a flow of cooling air on the circumference between two adjacent permanent magnets, wherein the cooling air flows in a channel located between said two adjacent permanent magnets.

13. The method according to claim 12 to obtain differential heating of the billet along a longitudinal axis of the billet, further comprising the steps of:

setting up a first and a second plurality of permanent magnets arranged in a ring and facing different axial portions of the billet; and making the first and the second plurality of permanent magnets arranged in a ring rotate at different speeds with respect to the billet.

14. The device according to claim 1, wherein the flow of cooling air is fed along a direction that is parallel to the axis of the tubular body.

15. The device according to claim 10, wherein the protective layer is a sheath.

16. The method according to claim 12, wherein the flow of cooling air is fed along a direction that is parallel to the axis of the tubular body.

* * * * *